US005998747A

United States Patent [19]

Kelso et al.

[11] Patent Number: 5,998,747

[45] Date of Patent: Dec. 7, 1999

[54] SWITCH PLATE ASSEMBLY

[76] Inventors: Francis Fredrick Kelso; James Patrick Reilly, both of 966 N. Gracsa, Camarillo, Calif. 93010

[21] Appl. No.: 09/072,826

[22] Filed: May 5, 1998

[51] Int. Cl.[6] ..... H01H 3/02

[52] U.S. Cl. ..... 200/331; 200/333; 174/66

[58] Field of Search ..... 174/66, 67; 200/294, 200/296, 297, 329, 331, 332.1, 330, 333; 220/241, 242

[56] References Cited

U.S. PATENT DOCUMENTS

| | | | |
|---|---|---|---|
| 3,004,128 | 10/1961 | Mikolajeski | 200/172 |
| 3,892,935 | 7/1975 | Patterson | 200/331 |
| 4,105,884 | 8/1978 | Damsky | 200/331 |
| 4,234,774 | 11/1980 | Paparella | 200/330 |
| 4,760,227 | 7/1988 | Boxer | 200/330 |
| 4,972,045 | 11/1990 | Primeau | 174/66 |

*Primary Examiner*—Michael A. Friedhofer
*Attorney, Agent, or Firm*—Henry G. Kohlmann; Snell & Wilmer

[57] ABSTRACT

In the present invention, a switch plate cover for an electrical toggle switch comprises three components. The first is a face plate which has an orifice and two standard screw holes for mounting to the switch. The second is a shaped toggle actuator cover which fits over the toggle actuator of the switch and partially through the orifice. The third is a base plate with a rectangular orifice for passage of the toggle switch/dimmer actuator to the toggle actuator cover. The combined components of the switch plate cover are mounted onto the toggle actuator of an electrical switch by placing the orifice of the third component and the hollow vertical second component directly on top of the toggle actuator and then affixing the combined face plate assembly to the switch plate with screws. In operation, the second component is slid up or down, such that the above-mentioned rectilinear displacement causes the actuator to move from one of its positions to the other of its positions.

8 Claims, 4 Drawing Sheets

SWITCH PLATE ASSEMBLY

BACKGROUND OF THE INVENTION

1. Field of the Invention

The invention relates to the field of switch plates for lights and the like and, more particularly, to a wall-mountable switch plate cover that fit over existing toggle switches and dimmers.

2. Prior Art

Conventional toggle switches and dimmers of standard configuration are well known throughout the United States. In fact, many homes have the old-fashioned toggle switches along with the less common dimmer toggles. As people update their homes and desire to more modern looking face plates and switches, they are forced to replace the original toggle switch or dimmer, as well as the face plate. However, many homeowners and do-it-yourself-ers do not feel comfortable handling electric wiring themselves and so are forced to hire an electrician. Since many homes have a multitude of such light switches, the cost of having an electrician replace all of them with more modern switches could be cost prohibitive.

In the prior art, the face plate that is designed to cover such toggle switches and dimmer usually has a rectangular orifice to allow passage of the switch/dimmer actuator itself. (The switch/dimmer actuator is the manually operated part of the switch/dimmer or the toggle.) The portion proximate the rectangular orifice covers the remaining, aesthetically undesirable elements of the electrical wiring and switch mechanism. The toggle assembly has two standard screw holes which align with corresponding holes in the cover plate. One hole is located above and one hole is located below the switch/dimmer actuator in the center of the plate.

One of the problems encountered by persons seeking to modernize or otherwise change the outward appearance of such standard toggle switches/dimmers and face plates is that the existing infrastructure of the electrical components is so established that it impedes substantial design changes, without complete replacement of the switch/dimmer itself. Thus, the prior art method of updating such face plates merely is to replace or otherwise modify only the visible portions only of the fixtures in question. For example, while the face plate may be changed so as to coordinate with other design elements (wallpaper, wall color, carpeting and the like) in the room, in the prior art it is difficult to change the color or shape of the toggle switch actuator, since it is part of the switch/dimmer mechanism that is attached to the electrical wiring. Thus, the old actuator (which remains visible after installation of the face plate) often conflicts with the style and/or color of the new face plate. Thus, even if it were possible to obtain a variety of colored or modern switch/dimmer actuators, changing the actuator would involve total replacement of the switch/dimmer mechanism, which is a time-consuming, skilled and expensive operation.

Therefore, there is a need to find a means of updating old toggle actuators in such a way that the switch/dimmer mechanism would not have to be replaced. Specifically, there needs to be a face plate assembly that can cover existing interior electrical components in such a way which makes use of the existing electrical infrastructure while hiding the switch/dimmer actuator which would conflict aesthetically with a cover plate of a different color or design.

OBJECTS OF THE INVENTION

It is therefore an object of the present invention to provide an exterior face plate assembly for an electrical box containing a toggle actuator wherein the existing electrical infrastructure is retained and yet the normally visible toggle actuator is wholly obscured by such a face plate assembly.

It is a further object to provide a face plate assembly for a toggle switch/dimmer to facilitate conversion of existing toggle actuator into an actuator that is a different style, shape, and/or color.

Another object is to provide a face plate assembly for a toggle switch/dimmer where the normally visible toggle actuator is obscured by an integrated toggle switch/dimmer assembly of homogeneous style and/or color.

It is yet a further object to provide a face plate assembly that reduces the risk of electrical shock from wet hands when actuating a switch to operate an electrical appliance such as a household garbage disposal.

SUMMARY OF THE INVENTION

The present invention provides an exterior face plate assembly for an electrical box containing at least one toggle switch/dimmer unit of standard design having two centrally positioned standard screw holes respectively above and below and equidistant from the switch/dimmer actuator. The assembly is designed to work with a toggle switch/dimmer unit wherein the toggle actuator resides in one of two rectilinearly interchangeable positions—one position being the "off" position and the other position being the "on" position.

When the device of the present invention is used as a dimmer switch, one position is the "off" position, such that as the toggle actuator is moved toward the other position, current is increased until the toggle actuator is fully at the other position. At the full other position, full current is provided so that the switch is fully "on", as in the case of a standard on-off toggle switch.

In the present invention, the face plate assembly comprises first, second and third components. The first component is a face plate of the desired style and color which has an orifice for passage of the second component. The first component further has two standard screw holes each of which corresponds to the toggle switch/dimmer assembly screw holes. On the back of the first component, there are two spacers which fixes the distance between the cover plate and the toggle actuator housing so that the back of the assembled unit lay flush to the wall. It also support the first component such that when it is screwed to the toggle actuator housing, it will not buckle inward.

The second component comprises a toggle switch/dimmer actuator covering means which fits over and integrally surrounds the currently existing toggle switch/dimmer actuator. The second component comprises a hollow vertical member which partially extends vertically through the orifice in the first component. The second component also comprises two extender means, one of each side thereof, which are placed within clipping means 52 and 53 on the rear of the face plate 12, of the third component, and extending from the front of the third component.

The third component has a substantially rectangular orifice for passage of the toggle switch/dimmer actuator. Each of the extension means on the second component is placed within the corresponding channel on the third component so as to allow guided, rectilinear displacement of the second component in a plane parallel to the first component. The extender means are placed within each channel such that the second component will not come off the third component.

On the back of the first component there are four snap fit retainers/clips which are spaced apart relative to each other which protrude beyond the back surface of the first component sufficiently to retain the outer edges of the third components. In addition, the back of the first component also contains a first and second substantially rectangular recesses. The first recesses contains the extension means on the second component so as to along guided rectangular displacement of the second component relative to the first component. The second recess positions the third component so that it is substantially square and parallel to the first surface.

The combined second and third component assembly is then attached to the first component by means of the snap fit retaining clips, such that the vertical part of the second component passes through the orifice on the first component. The combined face plate assembly is then mounted onto a toggle actuator switch/dimmer by placing the orifice of the third component and the hollow vertical second component directly on top of the toggle actuator and then affixing the combined face plate assembly to the switch/dimmer assembly by passing screws through two corresponding standard screw areas. In operation, the second component is slid up or down, such that the abovementioned rectilinear displacement causes the actuator to move from one of its positions to the other of its positions.

DESCRIPTION OF PREFERRED EMBODIMENTS

Figure 1:
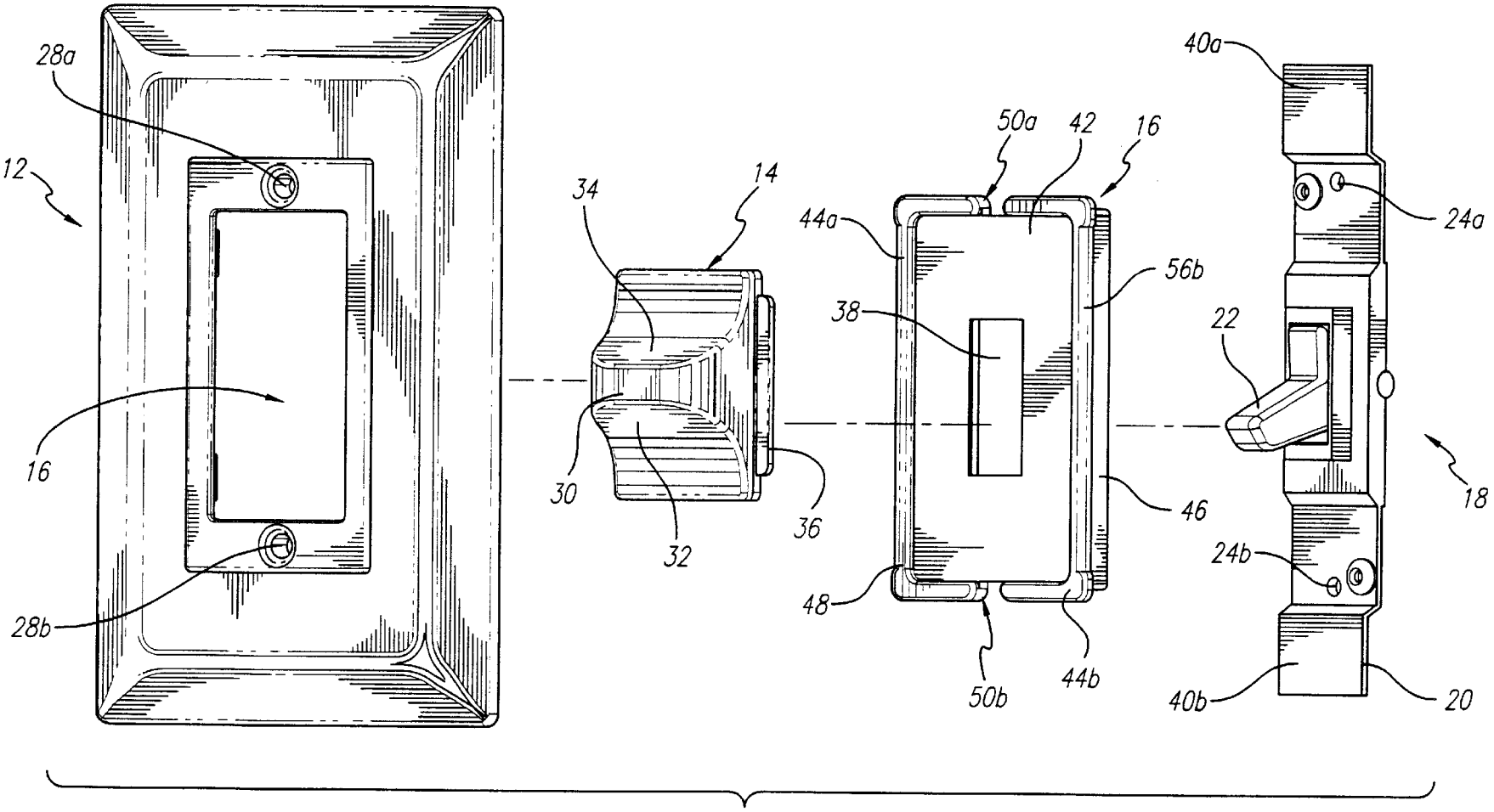
FIG. 1 is an exploded perspective view of the light switch/dimmer assembly.

Referring first to FIG. 1, an exploded perspective view of the light switch/dimmer assembly 10 suitable for a single toggle switch/dimmer assembly 18 is shown. Assembly 10 is comprised of a first component 12, a second component 14 and a third component 16. A toggle switch/dimmer assembly 18 of standard design is also shown, having a mounting bracket 20, a toggle actuator 22 and having two centrally positioned standard screw holes 24*a* and 24*b* respectively above and below and equidistant from the toggle actuator 22.

Figure 3:
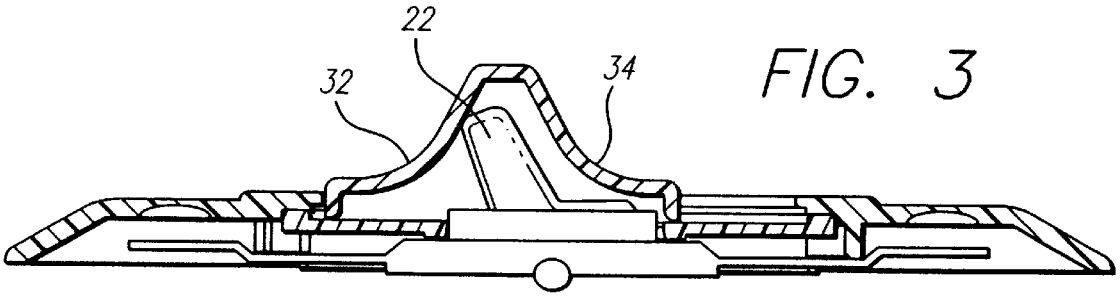
FIG. 3 is a cross-sectional view taken along lines 3—3 of FIG. 2.
Figure 4:
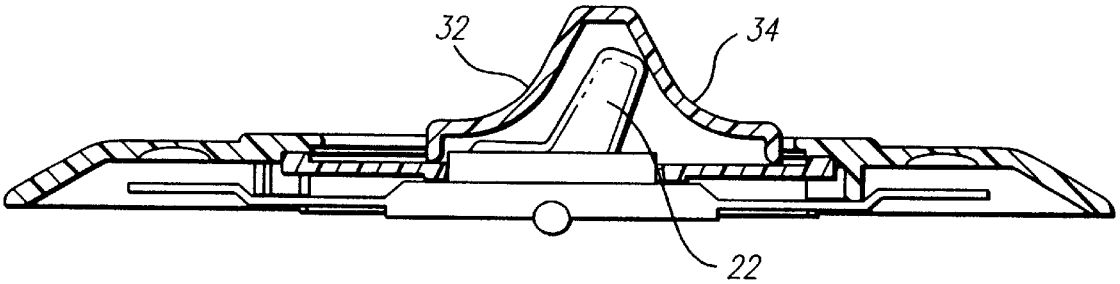
FIG. 4 is a cross-sectional view in the alternate position.

The toggle actuator 22 is capable of residing in one of two rectilinearly interchangeable positions—one position being the "off" position as shown in FIG. 3 and the other position being the "on" position as shown in FIG. 4.

The first component 12 is a face plate of the desired style and color which has an orifice 26 which is sized so that it is wide enough for the second component 14 to pass through and long enough so that the second component can move the toggle actuator 22 completely into each of its rectilinear "on" "off" positions. The first component 12 further has two standard screw holes 28*a* and 28*b*, each of which corresponds to toggle switch/dimmer assembly 18 screw holes 24*a* and 24*b*.

Figure 5:
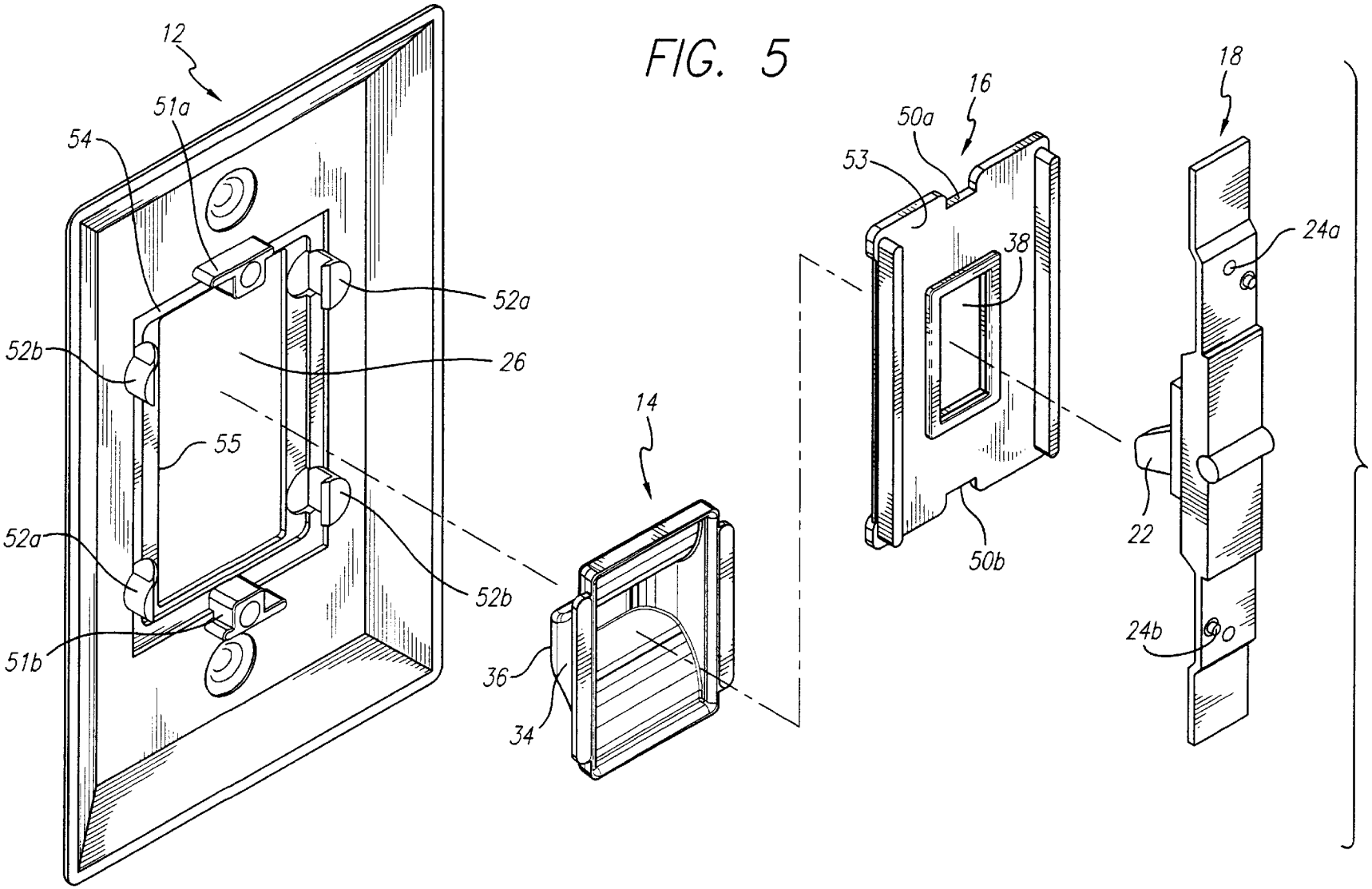
FIG. 5 is an exploded rear perspective view of the light switch/dimmer assembly.

Referring also to FIGS. 4 and 5, on the rear of the first component 12 there are a first and a second support pillar 51*a* and 51*b*. Support pillars 51*a* and 51*b* rest upon the front upper and lower portions 60*a* and 60*b* of switch assembly mounting bracket 20, which are shown in FIG. 1. Support pillars 51*a* and 51*b* are integrated into the back of the first component 12 and are proximately spaced from the screw holes. Support pillars 51*a* and 51*b* act as spacers between the first component and the mounting bracket 20 so that the second and third components 14 and 16 comfortably fit into the space that is created.

Support pillars 51*a* and 51*b* also support the first component 12 so that it will not buckle inward when the fully assembled assembly 10 is attached to the mounting bracket 20.

First component 12 also comprises retainer means 52*a*, 52*b*, 52*c* and 52*d*, which are affixed and integral to the back of first component 12. Retainer means 52*a*, 52*b*, 52*c* and 52*d* hold third component 16 in place such that second component 14 is securely retained between first component 12 and third component 16 at extension means 36 of component 14.

First component 12 is fabricated so that it has stepped recesses 54 and 55 proximate the opening 26. Specifically, recess 55 is substantially the same size and shape as the inside perimeter of channels 44*a* and 44*b* of third component 16. Recess 54 is substantially the same size and shape as the outside perimeter of channels 44*a* and 44*b*. When the components 12, 14 and 16 are assembled, recess 55 allows second component 14 to easily move up and down in hole 26.

Second component 14 comprises a hollow toggle switch/dimmer actuator cover 30, which fits over and is capable of integrally surrounding the currently existing toggle switch/dimmer actuator 22, as shown in FIGS. 3 and 4. In the preferred embodiment, the toggle switch/dimmer actuator cover 30 is shaped as a hollow trapezoid as shown in FIGS. 3 and 4, whereby the toggle actuator 22 may rest against the lower wall 32 in the "off" position and may rest against the upper wall 34 in the "on" position. Alternatively, toggle actuator 22 may rest against the upper wall 34 in the "off" position and may rest against the lower wall 32 in the "on" position. Walls 32 and 34 are spaced apart so that the toggle actuator can fit therein and maintain either an "on" or "off" position. When the second component 14 is moved in either direction, the toggle actuator 22 is forced to move, as it normally does when directly operated by hand from its "off" position to its "on" position (or vice versa).

On each side of the second component 14, there are extension means 36. In the preferred embodiment, the extension means are parallel to one another. The actuator cover 14 is shaped and sized so as to pass substantially through and extend vertically from the orifice 26 of the first component 12.

Third component 16 is substantially rectangular in shape. Third component 16 has a substantially rectangular orifice 38 for passage of the toggle switch/dimmer actuator 22 therethrough. The third component 16 is shaped on the underside thereof so as to fit on top of upper and lower 40*a* and 40*b* of switch/dimmer assembly mounting bracket 20 (shown in FIG. 1)such that the face 53 (shown in FIG. 5) thereof is substantially flush with the upper and lower parts 40*a* and 40*b* (as shown more particularly in FIGS. 3 and 4).

Third component 16 also comprises a pair of channels 44*a* and 44*b* which bilaterally flank the sides 46 and 48 of the front surface 42 thereof. The channels 44*a* and 44*b* are sized so as to movably contain the corresponding extension means 36 which are integrated into the sides of second component 14. Channels 44*a* and 44*b* allow guided, rectilinear displacement of the second component 14 in a plane parallel to the first component 12. Channels 44*a* and 44*b* are shaped so that extensions means 36 will not slide off the face 42 of third component 16.

In the preferred embodiment there are gaps 50*a* and 50*b* between channels 44*a* and 44*b* so as to allow support pillars 51*a* and 51*b* of first component 12 to pass therethrough and to rest upon bracket 20.

As shown in FIG. 5, the second component 14 is movably mounted upon first component 12, such that extender means 36 is parallel and squarely inset into recess 55, and the actuator cover 32 passes substantially through orifice 26 of first component 12. Actuator 32 extends vertically outward from orifice 26. Third component 16 is fixedly mounted within recess 54 of first component 12. Third component is retained within recess 54 by retainer means 52*a*, 52*b*, 52*c* and 52*d*, which hold sides 46 and 48 in place, such that sides 46 and 48 of third component 16 are parallel and squarely inset within recess 54. The third component is mounted so that the outside of channels 44*a* and 44*b* are flush against the back of first component 12.

Figure 2:
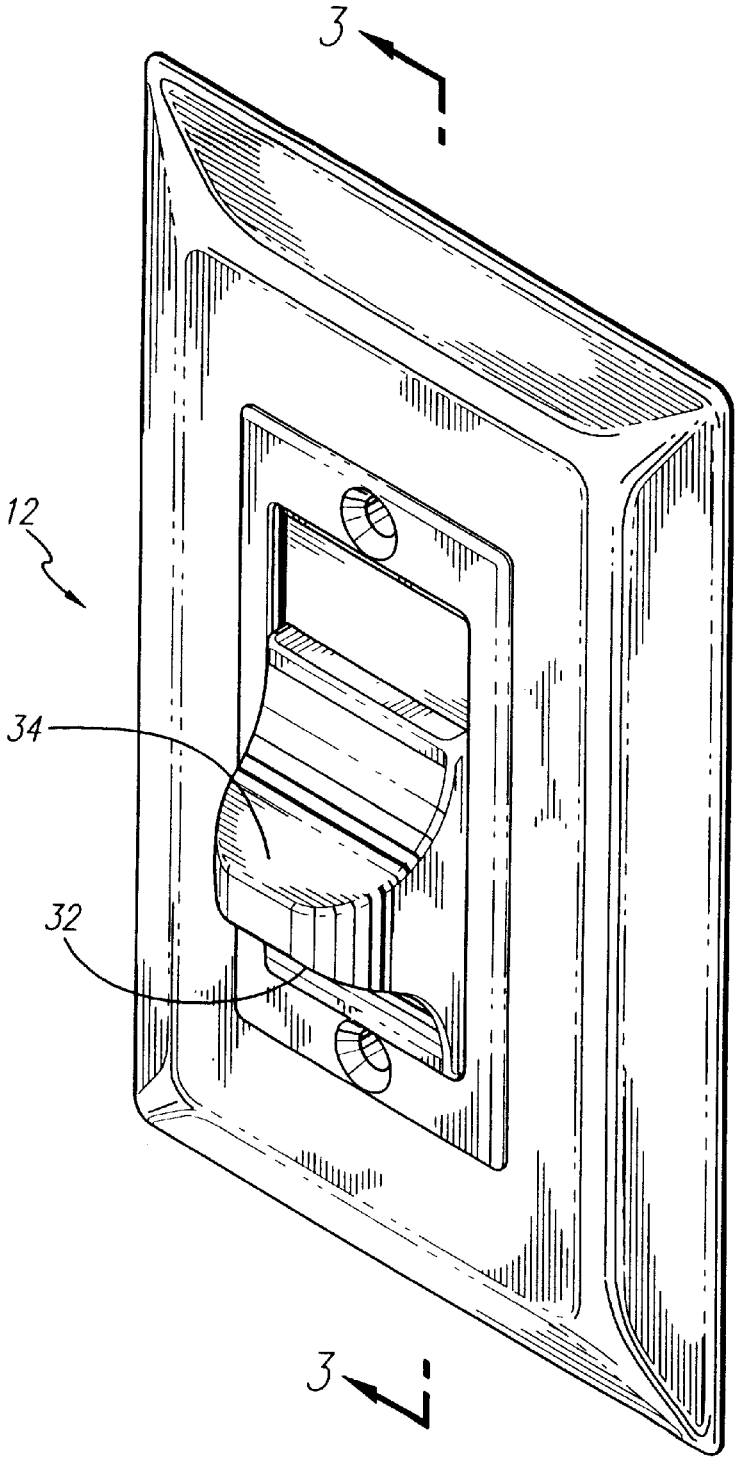
FIG. 2 is a perspective view of the top right front of the light switch/dimmer of the present invention.

The combined first, second and third components 10, 12 and 14 is mounted onto the toggle actuator switch assembly 18 by placing orifice 38 of third component 16 and the hollow vertical member of second component 14 directly on top of the toggle switch actuator 22. The combined face plate assembly 10 is then affixed to the toggle switch actuator assembly 18 by passing screws through holes 28*a* and 28*b* of first component 12 into corresponding holes 24*a* and 24*b* in mounting bracket 20, such that corresponding support pillars 51*a* and 51*b* sit atop of bracket 20 proximate screw holes 24*a* and 24*b*. The completed switch/dimmer plate assembly 10, as it looks completely assembled and affixed to a wall is shown in FIG. 2.

Referring more particularly to FIGS. 3 and 4, the face plate assembly operates by pushing either the upper or lower sides 34 and 32 of second component 14 in a direction towards the other side. This causes wall 32 or 34 to push toggle actuator 22 towards the other rectilinearly interchangeable position.

In operation, second component 14 is slid up or down, such that the rectilinear displacement caused thereby causes the actuator 22 which is resting along one wall thereof to move from one of its positions to the other of its positions as shown in FIGS. 3 and 4.

It is generally preferred that the slider be moveable two positions which are rectilinearly interchangeable so that there is a defined "off" position and a defined "on" position for the second component 14 corresponding to the two positions of the toggle switch/dimmer actuator 22.

In this manner, as people update their homes and desire to install more modern looking face plates and switch/dimmers, they do not have to replace the original toggle switch/dimmer. Thus, using the assembly of the present invention, many homeowners and do-it-yourself-ers do not have to handle the electric wiring themselves or be forced to hire an electrician.

Therefore, the present invention updates old toggle actuators so that the switch/dimmer mechanism does not have to be replaced. The assembly of the present invention covers the existing interior electrical components in such a way which makes use of the existing electrical infrastructure while hiding the switch/dimmer actuator which would conflict aesthetically with a cover plate of a different color or design.

While particular embodiments of the invention have been shown and illustrated herein, it will be understood that many changes, substitutions and modifications may be made by those persons skilled in the art. It will be appreciated from the above description of presently preferred embodiments that other configurations are possible and within the scope of the present invention. Thus, the present invention is not intended to be limited to the particular embodiments specifically discussed hereinabove.

What is claimed is:

1. A cover assembly for an electrical box containing at least one switch having a toggle actuator and a plurality of first screw holes; said cover assembly having at least two second screw holes for fastening said cover assembly to said switch; said toggle actuator having at least two selectable positions, the cover assembly comprising:

outer covering means having a substantially rectangular orifice and a guiding mean; said outer covering means covering said switch, said at least two second screw holes corresponding to at least two of said plurality of first screw holes in the switch;

pushing means having a hollow component which is received by said substantially rectangular orifice in said outer covering means and which receives at least part of the toggle actuator, wherein said pushing means further comprises a base and two extension means extending from opposite sides of said base transverse to the direction of motion of said base which slidably engage with said guiding means, such that said pushing means is slidable to move the toggle actuator between said at least two selectable positions; and switch plate covering means, having a substantially rectangular orifice through which the toggle actuator moves between said at least two selectable positions.

2. A cover assembly for covering at least a part of an electrical switch having a toggle actuator, said cover assembly comprising:

a. a base plate having a rectangular hole for permitting at least a part of said toggle actuator to extend through said base plate:

b. a toggle actuator cover in slidable engagement with said base plate, having a recess receiving and operatively engaging a part of said toggle actuator which extends through said base plate, said toggle actuator cover having a plurality of extensions on opposite sides of said toggle actuator cover; and c. an assembly cover plate for receiving said base plate, said assembly cover plate having fastener holes for mounting said assembly cover plate and having a generally rectangular hole with at least two recesses disposed in opposite sides thereof adjacent said base plate, said recesses maintaining slidable engagement along a surface of at least two of said extensions of said toggle actuator cover.

3. A cover assembly as described in claim 2 wherein said assembly cover plate further comprises:

a. a plurality of retainer posts adjacent said recesses for removably engaging said base plate in a fixed position relative to said assembly cover plate.

4. A cover assembly for covering at least one electrical switch having a toggle actuator, mounted in an electrical box, said cover assembly comprising:

a. a generally rectangular base plate having a plurality of spacers mounted along a longitudinal axis of said base plate for engaging a surface of said switch, said base plate having a central rectangular hole for permitting at least part of said toggle actuator to extend through said base plate;

b. a toggle actuator cover in slidable engagement with said base plate, having a recess receiving and operatively engaging a part of said toggle actuator which extends through said base plate, said toggle actuator cover having a plurality of extensions on opposite sides of said toggle actuator cover; and c. an assembly cover plate for fixedly receiving said base plate, said assembly cover plate having fastener holes for mounting said assembly cover plate and having a generally rectangular hole with at least two recesses disposed in opposite sides thereof adjacent said base plate maintaining slidable engagement with a surface of at least two of said extensions of said toggle actuator cover, said assembly cover plate further comprising a plurality of retainer posts adjacent said recesses for removably engaging said base plate in a fixed position relative to said assembly cover plate.

5. A cover assembly for covering at least part of an electrical switch having a toggle actuator having an "on" position and an "off" position, mounted, said cover assembly comprising:

a. a generally rectangular base plate having a plurality of spacers mounted along a longitudinal axis of said base plate for engaging a surface of said switch, said base plate having a central rectangular hole for permitting at least part of said toggle actuator to extend through said base plate;

b. a toggle actuator cover in slidable engagement with said base plate, having a recess receiving and operatively engaging a part of said toggle actuator which extends through said base plate for operation between said "on" position and said "off" position, said toggle actuator cover having a plurality of extensions on opposite sides of said toggle actuator cover; and c. an assembly cover plate for fixedly receiving said base plate, said assembly cover plate having fastener holes for mounting said assembly cover plate and having a generally rectangular hole with at least two recesses disposed in opposite sides thereof adjacent said base plate maintaining slidable engagement with a surface of at least two of said extensions of said toggle actuator cover.

6. A cover assembly as described in claim 5 wherein said assembly cover plate further comprises:

a. a plurality of retainer posts adjacent said recesses for removably engaging said base plate in a fixed position relative to said assembly cover plate.

7. A cover assembly for covering an electrical switch having a toggle actuator having an "on" position and an "off" position, said cover assembly comprising:

a. a generally rectangular base plate having a plurality of spacers mounted along a longitudinal axes of said base plate for engaging a surface of said switch, said base plate for engaging the surface of said switch, said base plate having a central rectangular hole for permitting at least part of said toggle actuator to extend through said base plate;

b. a toggle actuator cover in slidable engagement with said base plate, having a recess receiving and operative engaging a part of said toggle actuator which extends through said base plate for operation between said "on" position and said "off" position, said toggle actuator cover having a plurality of extensions on opposite sides of said toggle actuator cover; and c. an assembly cover plate for fixedly receiving said base plate, said assembly cover plate having fastener holes for mounting said assembly cover plate and having a generally rectangular access hole with at least two recesses disposed in opposite sides thereof adjacent said base plate maintaining slidable engagement with substantially a surface of at least two of said extensions of said toggle actuator cover, said assembly cover plate further comprising a plurality of retainer posts adjacent said recesses for removably engaging said base plate in a fixed position relative to said assembly cover plate.

8. A cover assembly as described in claim 7 wherein said assembly cover plate further comprises:

a plurality of recesses on opposite sides of the assembly cover plate adjacent said toggle actuator cover plate for slideably receiving said toggle actuator cover plate.

* * * * *